US007101459B2

(12) United States Patent
Nisogi et al.

(10) Patent No.: US 7,101,459 B2
(45) Date of Patent: Sep. 5, 2006

(54) PRINTING COATED PAPER

(75) Inventors: Hideaki Nisogi, Tokyo (JP); Jun Makihara, Tokyo (JP); Takehide Kasahara, Tokyo (JP); Takashi Ochi, Tokyo (JP); Hirokazu Morii, Tokyo (JP); Hideki Fujiwara, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 49 days.

(21) Appl. No.: 10/312,371

(22) PCT Filed: Jun. 26, 2001

(86) PCT No.: PCT/JP01/05458

§ 371 (c)(1),
(2), (4) Date: Sep. 12, 2003

(87) PCT Pub. No.: WO02/01000

PCT Pub. Date: Jan. 3, 2002

(65) Prior Publication Data

US 2004/0045686 A1 Mar. 11, 2004

(30) Foreign Application Priority Data

Jun. 27, 2000 (JP) ..... 2000-193517
Aug. 21, 2000 (JP) ..... 2000-249581
Aug. 21, 2000 (JP) ..... 2000-250008

(51) Int. Cl.
*D21H 19/36* (2006.01)

(52) U.S. Cl. ..... 162/135; 162/179; 162/158; 162/181.8; 162/175; 428/341; 427/361

(58) Field of Classification Search ..... 162/135, 162/158, 181.1–181.8, 175, 179, 204–206; 427/361, 391; 428/340–341, 195.1
See application file for complete search history.

(56) References Cited

U.S. PATENT DOCUMENTS

| | | | | | |
|---|---|---|---|---|---|
| 3,480,456 | A * | 11/1969 | Forkner | 427/4 |
| 3,953,421 | A * | 4/1976 | Berstein | 524/446 |
| 4,048,380 | A * | 9/1977 | Blakey et al. | 428/511 |
| 4,338,597 | A * | 7/1982 | Steiner et al. | 345/213 |
| 5,302,249 | A * | 4/1994 | Malhotra et al. | 162/135 |
| 5,637,196 | A | 6/1997 | Ogawa et al. | |
| 5,798,173 | A | 8/1998 | Momma et al. | |
| 5,888,625 | A * | 3/1999 | Kobayashi et al. | 428/32.11 |
| 5,984,467 | A * | 11/1999 | Bodager et al. | 347/101 |
| 6,068,733 | A | 5/2000 | Storbeck et al. | |
| 6,402,827 | B1 * | 6/2002 | Freeman et al. | 106/487 |
| 2004/0045686 | A1 * | 3/2004 | Nisogi et al. | 162/135 |
| 2004/0099391 | A1 * | 5/2004 | Ching et al. | 162/135 |
| 2005/0016701 | A1 * | 1/2005 | Nisogi et al. | 162/135 |

FOREIGN PATENT DOCUMENTS

| | | | |
|---|---|---|---|
| EP | 0 440 419 | A1 | 8/1991 |
| EP | 0 953 544 | A1 | 11/1999 |
| EP | 1 001 082 | | 5/2000 |
| JP | 05051900 | A * | 3/1993 |
| JP | 06 073686 | | 3/1994 |
| JP | 09-302596 | | 11/1997 |
| JP | 11-200284 | | 7/1999 |

* cited by examiner

*Primary Examiner*—José A. Fortuna
(74) *Attorney, Agent, or Firm*—Knobbe, Martens, Olson & Bear LLP

(57) ABSTRACT

A coated printing paper the product of whose basis weight, density, Young's modulus in the machine direction and breaking length in the machine direction is within the range of no less than $1.0\times10^{21}g^2\cdot N/m^6$ but not greater than $4.0\times10^{21}g^2\cdot N/m^6$, and which offers excellent pliability, superior print gloss in the image area regardless of lower white-paper gloss, minimal small-scale gloss variations in the image area, and excellent workability with the printing machinery, more particularly a matte coated paper, is provided.

17 Claims, No Drawings

PRINTING COATED PAPER

This application is the U.S. National Phase under 35 U.S.C. §371 of International Application PCT/JP01/05458, filed Jun. 26, 2001, which claims priority to Japanese Patent Application Nos. 2000-193517 filed Jun. 27, 2000, 2000-249581 filed Aug. 21, 2000, and 2000-250008 filed Aug. 21, 2000. The International Application was published under PCT Article 21(2) in a language other than English.

FIELD OF THE INVENTION

This invention relates to a coated printing paper that provides higher bulk (lower density) yet excellent pliability along with great workability with the printing machinery. The invention concerning the coated printing paper also relates to a matte coated paper that offers higher bulk (lower density), excellent pliability, superior print gloss in the image area regardless of lower sheet gloss, minimal small-scale gloss variations, and great workability with the printing machinery.

BACKGROUND OF THE INVENTION

Concurrent with the advanced visual and color features that have found applications in printed materials during recent years, there has been an increased demand for printing papers having higher quality. On the other hand, there is a great demand for weight reduction in printed materials for the sake of reduced costs in transportation and mailing. Traditionally these two demands have been mutually contradictory, given that high-quality coated printing papers are conventionally characterized by higher basis weight of the base paper and greater coating weight, as well as higher density for a given basis weight due to smoothing through surface treatment. A paper with a lower basis weight may be selected in order to reduce the weight of a printed material. However, that is not an ideal solution, since using such a means of weight reduction without changing the density will result in thinner paper and diminish the feeling of bulk expected of a book. For the above reasons, the market is presently demanding high-quality coated papers that ensure higher bulk; in other words, which offer greater paper thickness at a given basis weight or a lower basis weight at a given paper thickness, and which meet the criteria required of coated papers used for upscale printing applications.

Recently there has also been a trend of public preference for small-size, handy information magazines such as the so-called "mook" (magazine-format book) and "pocket guide." Pliability is one of the important features required of papers used for these publications. If a rigid paper is used for such magazines, the smaller the size of the book becomes, the more easily the pages will stand straight as they're flipped up and over, making it extremely inconvenient to open and read the book while holding it with one hand, for example, when one is on the road. One of the indicators used to measure the level of paper pliability is the Clark stiffness tester. Paper stiffness increases in proportion to the cube of the paper thickness. If the paper thickness is increased to gain higher bulk at a given basis weight, the paper stiffness increases accordingly. Given the above, it has traditionally been considered extremely difficult to achieve a paper offering excellent pliability and higher bulk at the same time.

The possible means of achieving higher bulk include the manufacturing of a bulky coated base paper through the use of a bulk pulp and bulk filler material, a reduction of the coat weight, and the lessening of surface treatment for the coated paper thus obtained.

Pulps for paper production are generally classified into chemical pulps and mechanical pulps. Chemical pulps are produced using a chemical that extracts the lignin from the fibers. Mechanical pulps, which are made without the use of chemicals, include the ground wood pulp—which is produced by grinding wood chips with a grinder—and the thermo-mechanical pulp, which is made by crumbling wood chips into fibers in a refiner. Generally, the mechanical pulp has stiffer fibers than the chemical pulp and is therefore more effective in providing higher bulk (lower density). However, the mechanical pulp will result in problems such as decreased whiteness if it's blended in a high-quality paper, and will easily cause printing defects such as picking due to shives if it's blended in a medium-quality paper. Thus there is a limit to the amount of mechanical pulp content that can be used in the paper. Furthermore, pulp from recycled paper is increasingly being used due to the recent public trend toward environmental preservation and the need to protect natural resources. Generally, however, recycled paper pulp is often produced by mixing fine paper, newsprint, magazine paper, coated papers and other used papers, and thus has a higher density than virgin mechanical pulp (unused pulp that has never made into paper) and cannot provide higher bulk.

As explained above, it is difficult to achieve sufficient paper bulk by working solely with pulp factors, especially when one considers the preservation of wood resources and the quality design of paper. Moreover, a simple blending of the above-described pulps for the sake of higher bulk results in greater stiffness, which makes it impossible to obtain sufficient pliability in the paper.

An example of the use of a bulky filler material in the base paper for use in a coated stock, in order to achieve higher bulk, is described in Japanese Patent Application Laid-open No. 5-339898, which discloses a technique used to achieve lower density through the blending of hollow synthetic organic capsules. However, such synthetic organic matter degrades the paper strength and causes printing problems such as picking and tearing, while a greater percentage of said matter needs to be blended to achieve a sufficient bulk effect, resulting in a higher production cost. A method of using a shirasu balloon is proposed in Japanese Patent Application Laid-open No. 52-74001. However, the shirasu balloon does not mix well with the pulp, and the paper blended with it causes print variations and other problems. In short, it is impossible to achieve pliability in the paper even through the use of any of the techniques so far discussed in this document.

The coating layer of the coated paper generally has a higher density than the base paper. Therefore, the coated paper has a higher density than the printing paper with no coating layer. A coated paper with higher bulk may be achieved by applying a smaller amount of coating composition. This is due to a smaller percentage of the coating layer relative to the overall coated paper. However, there has traditionally been a limit to the use of the coating layer in a smaller percentage as a means of reducing the amount of coating while maintaining the target quality, since it will also diminish the coverage of the base paper by the coating layer, thereby reducing the print quality such as white-paper gloss, smoothness and print gloss.

Enhancing the smoothness of the coated paper is one of the effective means of improving the print quality of the coated paper, particularly the degree of ink receptivity and gloss of the image area (hereinafter referred to as "print gloss"). Therefore, the process of smoothing the surface of the paper, such as super-calendering or soft nip-calendering, is generally used for glossy paper and the dull-coat paper having a level of white-paper gloss falling between those of the matte and glossy papers. However, such processes involve pressing the paper to achieve a smoother surface, thereby reducing the paper thickness and often making it impossible to gain a degree of bulk sufficient to achieve the target print quality.

The method of manufacturing general matte coated papers, on the other hand, is mainly intended to minimize sheet gloss, and therefore has conventionally used coatings blended with pigments having higher average particle diameters. For example, the primary pigments used in the coating disclosed in Japanese Patent Application Laid-open No. 8-60597 feature larger particle diameters and include 30 parts by weight of Escalon 1500, a type of ground calcium carbonate (average particle diameter: 1.65 μm) and 50 parts by weight of Hydrasperse, a No.2 kaoline (average particle diameter: 1.61 μm), thereby making it difficult to increase the smoothness, white-paper gloss and print gloss of the paper to the respective target levels.

The dull-coat paper, which is generally obtained through the application of a slight surface treatment to the matte coated paper, provides a higher print gloss than the matt coated paper but requires the enhancement of surface-treatment conditions if greater print gloss must be obtained. Therefore, as with the case of matte coated paper, it has been difficult to maintain the bulky feel of the dull-coat paper by manufacturing a stock of lower density. For example, as is disclosed in Japanese Patent Application Laid-open No. 7-119086, there is a technique for improving smoothness while minimizing white-paper gloss by selecting a higher roughness setting for the roller surface of the super-calender, which is commonly used as a surfacetreatment device. However, if the paper is finished with a calender having a stack of six or more rolls, the paper's density increases and bulk decreases, making it impossible to obtain a matte coated paper having the target bulk level.

Additionally, one technique for improving print gloss while producing a lower density and minimizing the sheet gloss is the use of a calender combining metal and resin rollers having rough surfaces. It is the process of surface treatment at a temperature of 100° C. using metal rollers having rough surfaces, as disclosed in, for example, Japanese Patent Application Laid-open Nos. 6-73685, 6-73686, 6-73697 and 7-238493. However, even with the use of such technologies it remains difficult to obtain a printing paper that offers the level of bulk targeted in the present invention.

Given the above circumstances, the purpose of the present invention is to provide a coated printing paper that provides higher bulk (lower density) yet excellent pliability, great workability with the printing machinery, higher print gloss regardless of lower sheet gloss, minimal small-scale gloss variations in the image area, and superior print quality.

SUMMARY OF THE INVENTION

The inventors of the present invention have carried out extensive studies under the challenging circumstances described above, and as a result have discovered that a coated printing paper that provides higher bulk and superior pliability, as well as greater resistance to the tearing that can result from the printing machinery, along with excellent workability, can be obtained by defining the relevant specifications so that the product of the basis weight, density, Young's modulus in the machine direction and breaking length in the machine direction of the coated printing paper having a coating layer containing pigments and adhesives on top of the base paper will be no less than $1.0\times10^{21}$ $g^2\cdot N/m^6$ but not greater than $4.0\times10^{21}$ $g^2\cdot N/m^6$, or preferably no less than $2.0\times10^{21}g^2\cdot N/m6$ but not greater than $3.5\times10^{21}$ $g^2\cdot N/m^6$. Particularly, a coated printing paper with higher bulk, superior pliability and excellent print quality can be obtained in the present invention if at least 9 to 25 $g/m^2$ of the coating layer is applied to each side of the coated paper.

In conducting studies of the paper's pliability, the inventors directed their attention to the ease with which one might flip the pages of a book. Generally, paper stiffness is evaluated quantitatively using the Clark stiffness tester, a pure bending stiffness tester or the like. The results of studies regarding the correlations among the ease of flipping the pages of several types of books felt by the panelists, as well as the pure bending stiffness in the machine direction and cross machine direction, indicated that paper having less stiffness tended to be more pliable. Some papers, however, showed different results for the sensory test regarding the ease of flipping pages even when their stiffness levels were the same. In other words, it was found that paper pliability could not be evaluated solely according to bending stiffness.

When a page is flipped over, bending stress is applied to the paper, causing the paper's convex and concave surfaces to be subjected to tensile and compressive stresses, respectively. The correlations among the Young's modulus in the machine direction and cross machine direction and the ease of flipping were then investigated, and as a result it was confirmed that the page was flipped more easily with a lower Young's modulus in the machine direction and cross machine direction, even if the pure bending stiffness in the cross direction was the same. While the results of Young's modulus in the machine direction and cross machine direction showed a positive correlation in many of the tested papers, it was discovered that, particularly, the paper with a lower Young's modulus in the machine direction offered greater ease of flipping and superior pliability along with greater resistance to tearing while printing with a web offset press. This was attributable to steady web operation due to minimal variations of tension at the paper feeder, cooling roller and other relevant sections.

The inventors also studied the relationship between the paper's strength and pliability and found that the paper with a shorter breaking length tended to offer greater pliability when comparing papers of the same thickness. For example, the paper with a longer breaking length forms more hydrogen bonds between pulp fibers and tends to provide relatively greater strength, yet such paper requires relatively higher bending or tensile stress to obtain a given flexural or tensile strain, thus making it more difficult to flip the pages.

Accordingly, it was discovered that the technique, which helps improve the paper's pliability while simultaneously reducing the paper's Young's modulus and breaking length at an optimal balance, could also be applied to bulkier papers, meaning those papers having greater thickness for a given basis weight. Additional in-depth studies have suggested that the ranges of Young's modulus and breaking length required to achieve the target pliability differed according to density and basis weight, and that excellent pliability could not be obtained in the paper with a greater basis weight unless the Young's modulus or breaking length was reduced accordingly. In other words, the findings suggest that the paper's pliability has a good correlation with the product of the four respective elements: basis weight, density, Young's modulus in the machine direction and breaking length in the machine direction. It was found that if the product of the four elements was within the range of no less than $1.0\times10^{21}$ $g^2\cdot N/m^6$ but not greater than $4.0\times10^{21}$ $g^2\cdot N/m^6$, or preferably no less than $2.0\times10^{21}$ but not greater than $3.5\times10^{21}$ $g^2\cdot N/m^6$, the coated printing paper manufactured to such specifications would provide greater ease in flipping the pages of the printed papers bound into a book, and that its higher bulk helped ensure a greater feeling of bulk while said paper was less prone to tearing during the printing process and provided excellent workability. This invention gave birth to a paper having a level of pliability that could not be achieved through the higher bulk gained with any of the previously available technologies or any combination of such technologies, by reducing the Young's modulus and breaking length at an optimal balance, and that provides excellent workability with the printing machinery.

The paper with a normal density level and the product of the four elements being less than $1.0\times10^{21}$ $g^2\cdot N/m^6$ at a given basis weight means it has an extremely low Young's modulus or short breaking length. Such a paper is too pliable to provide the strength sufficient to flip pages easily, or is more prone to tearing since the paper has greater strain associated with tension in the printing machinery and therefore ruptures when it elongates beyond the limit of elasticity. Moreover, the paper with a normal Young's modulus and breaking length and the product of the four elements being less than $1.0\times10^{21}$ $g^2\cdot N/m^6$ at a given basis weight is characterized by an extremely low density. For such a paper, the pressures of the press and calender must be set to extremely low levels during the paper manufacturing process, thus resulting in significantly less smoothness and poor print quality.

Contrastingly, the paper with a normal density level and the product of the four elements exceeding $4.0\times10^{21}$ $g^2\cdot N/m^6$ at a given basis weight means it has an extremely long breaking length or high Young's modulus. Such a paper cannot provide good pliability due to its stiffness, and is more prone to tearing and other print problems given that the paper becomes stiffer at a higher Young's modulus, and also because certain areas of the paper are subjected to large amounts of stress since it cannot fully absorb the variations in tension occurring during the printing process. Moreover, the paper with a normal Young's modulus and breaking length and the product of the four elements exceeding $4.0\times10^{21}$ $g^2\cdot N/m^6$ at a given basis weight is characterized by an extremely high density, and cannot be made into a coated printing paper with higher bulk and the excellent bulky feel that are intended in the present invention.

Additionally, a matte coated paper that offers higher print gloss (gloss in the image area of the printed matter) regardless of lower sheet gloss and minimal small-scale gloss variations (excellent print-surface feel) in the image area, as intended in the present invention, cannot be obtained even if the paper's basis weight, density, Young's modulus in the machine direction and breaking length in the machine direction are set within the above-specified ranges.

The inventors have also conducted extensive studies regarding coating compositions, and as a result have found that the coatability of the base paper by the coating layer could be improved through a narrow distribution of pigment particle diameter; that is, by narrowing the particle-size distribution.

Specifically, unlike synthetic organic particles such as plastic pigments, which comprise particles of fairly uniform particle diameter, inorganic pigments in the coating compositions commonly used have a broader particle-diameter distribution since they comprise a mixture of large and small particles when the particle is packed. The volume fraction of particle for the mono-dispersion of spherical particles of the same diameter is not dependent on the particle diameter and remains constant, while the particle filling rate for a poly-dispersion—for example, a mixture of spherical particles of two different diameters—is dependent on the ratio of the larger and smaller diameters and the mixture ratio of the two types of particles, thus resulting in a higher volume fraction of particle (a value obtained by dividing the smaller particle diameter by the larger particle diameter). Accordingly, it was concluded that the coating layer comprising a narrow size distribution of pigment particles was characterized by having a relatively larger diameter for the small particle size or a smaller diameter for the large particle size than the coating layer of a wider particle size distribution, and that either of these characteristics or the effect from both of said characteristics caused the pigment particle filling ratio to decrease, thereby reducing the density of the coating layer.

While the increase of the coat weights is effective in improving the coverage of the base paper by the coating layer, it is not suitable for the production of a bulky coated paper because the use of a higher percentage of the coating layer having a higher density than the base paper will result in a higher density of the coated paper overall. To improve the smoothness of the base paper with the coating layer at a given amount of coating, it is necessary to reduce the density of the coating layer. Therefore, it is understood that reducing the pigment particle filling rate for the coating layer comprising a mixture of particles in many different diameters will reduce the density of the coating layer and thus improve the coatability of the base paper.

The above discussions proved that a high-quality matte coated paper having superior print gloss despite lower white-paper gloss and excellent print-surface feel could be obtained by specifying the size distribution of the pigment particles contained in the coating layer. Specifically, it was found that coatability of the base paper by the coating layer could be improved to a significant degree by specifying the particle-diameter distribution so that 65 percent or more of the pigment particles in the coating layer were within the range of 0.4 to 4.2 μm on a volumetric basis, and that a matte coated paper with even more superior coatability could be obtained with a content of 20 parts, preferably 50 parts, but most preferably 70 parts or more of kaoline having the particle-diameter distribution in which 65 percent or more of particles in the coating layer were within the range of 0.4 to 4.2 μm on a volumetric basis. The above finding is explained by the formation of a bulky coating layer having a lower particle filling density along with a significant improvement in coatability of the base paper made possible by plate-shaped kaolin particles covering small pores of the base paper to prevent the entry of pigments.

If pigments in the coating compositions have less than 65 percent of particles within the range of 0.4 to 4.2 μm on a volumetric basis and contain many particles of smaller diameter, the particle filling density increases and those particles do not remain on the surface layer of the base paper, given that they enter the small pores on the surface of the base paper, thereby diminishing the coatability of the base paper, lowering the print gloss, producing many small-scale gloss variations and a poorer print-surface feel. If said pigments have less than 65 percent of particles within the range of 0.4 to 4.2 μm on a volumetric basis and contain many particles of larger diameter, a smaller percentage of particles will enter the small pores on the surface of the base paper but the particle filling density will become higher and coarse particles will reduce the smoothness, resulting in lower sheet gloss and print gloss, many small-scale gloss variations, and poorer print-surface feel.

The volumetric particle-size distribution measurement discussed in the present invention refers to the measurement of the volumetric size distribution of particles using the laser diffraction/dispersed particle-size distribution measurement method (the Mastersizer S, laser diffraction/dispersed particle-size distribution measurement instrument, manufactured by Malvern).

BEST MODE FOR CARRYING OUT THE INVENTION

To keep the product of the paper's basis weight, density, Young's modulus in the machine direction and breaking length in the machine direction within the range of no less than $1.0\times10^{21}$ $g^2\cdot N/m^6$ but not greater than $4\times10^{21}$ $g^2\cdot N/m^6$, it is desirable to combine me reducing the paper's density, Young's modulus in the machine direction and breaking length in the machine direction, respectively. Methods for reducing the paper's density include the increased mixture ratio of low-density pulp and low-density fillers, the use of bulky chemical(s) and the reduction of press pressure or the machine calender's line pressure during the paper manufacturing process. The use of a softening agent is a method for reducing the paper's Young's modulus. One of the methods for reducing the paper's breaking length in the machine direction is to increase a compounding ratio of filler.

Relative to the present invention, the types of pulps blended in the base paper include bleached hardwood kraft pulp (hereinafter referred to as "LBKP"), bleached softwood kraft pulp (hereinafter referred to as "NBKP"), thermomechanical pulp, ground wood pulp, and recycled pulp. The use of chemical pulps such as LBKP and NBKP is preferable to achieve better fiber puffing by the printing machine. Moreover, the inclusion of filler(s) in the paper is recommended, since that tends to reduce the Young's modulus. Publicly known fillers, including ground calcium carbonate, precipitated calcium carbonate, kaolin, clay, talc, hydrated silicate, white carbon, titanium oxide and synthetic-resin filler, may be used. The amount of filler recommended for the reduction of Young's modulus is 6 wt-% or more, and preferably 10 wt-% or more. Furthermore, aluminum sulfate, sizing, paper-strengthening agent, softening agent, retention-aiding agent, colorant, dye, antifoamer and other agents may be added as necessary.

The softening agent used in the present invention either acts to prevent the inter-fiber bonding of the pulp or to soften the fiber itself. Examples of recommended softening agents include hydrophobic and hydrophilic compounds such as oil-based nonionic surfactants; sugar alcohol-based nonionic surfactants; sugar-based nonionic surfactants; polyhydric alcohol-based nonionic surfactants; higher alcohol; ester compound of polyhydric alcohol and fatty acid; polyoxyalkyleneadditive of higher alcohol or higher fatty acid; polyoxyalkyleneadditive which is an ester compound of polyhydric alcohol and fatty acid; and fatty acid polyamidoamine. Because it is preferable to use a softening agent capable of reducing the pure bending stiffness and density as well as the Young's modulus, the use of ester compound of polyhydric alcohol and fatty acid is recommended.

Relative to the present invention, a surface-treatment agent primary made from water soluble polymer may be applied on the base paper for the purpose of improving its surface strength and sizing properties, to the extent that the application of such an agent does not affect the density, Young's modulus or breaking length. Any one of an oxidized starch, hydroxyethyl etherified starch, enzyme-modified starch, polyacrylamide or polyvinyl alcohol, which are commonly used as surface-treatment agents, or any combination of the above may be used as a water-soluble polymer. In addition to the water-soluble polymer, the paper-strengthening agent may be added to the surface-treatment agent for the sake of improving water resistance and surface strength, along with sizing additive for improved sizing properties. The surface treatment agent can be applied using a coating machine such as a two-roll-size press coater, gate-roll coater, blade-type metering-size press coater, rod-type metering-size press coater, or a film-transfer roll coater like a symsizer. The base paper used for the coated printing paper in the present invention may have either an acid, neutral or alkaline pH level.

The present invention is one in which a coating layer containing pigments and adhesives is provided for the base paper, to the extent that such a layer does not affect the density, Young's modulus or breaking length.

Specifically, any one or more of inorganic pigments, including kaolin, clay, delaminated clay, ground calcium carbonate, precipitated calcium carbonate, talc, titanium dioxide, barium sulfate, calcium sulfate, zinc oxide, silicic acid, silicate, colloidal silica and satin white, as well as organic pigments such as plastic pigments, which have conventionally been used as pigments for the coating layer of the coated paper, may be selected for use as necessary.

Regarding the adhesive(s) for use in the present invention, any one or more of the following adhesives—which have conventionally been used for coated papers—may be selected as needed: synthetic adhesives such as styrene/butadiene, styrene/acryl, ethylene/vinyl acetate, butadiene/methyl methacrylate, vinyl acetate/butylacrylate and other copolymers, as well as polyvinyl alcohol, maleic anhydride copolymer and acrylate/methyl methacrylate copolymer; proteins such as casein, soybean protein and synthetic protein; starches such as oxidized starch, cathionic starch, urea/phosphate esterified starch, hydroxyethyl etherified starch and other etherified starches, and dextrin; and cellulose derivatives such as carboxymethyl cellulose, hydroxyethyl cellulose and hydroxymethyl cellulose. These adhesives are used at levels of 5 to 50 parts by weight, or preferably 5 to 25 parts by weight, to 100 parts by weight of pigments. Additionally, a dispersant, thickener, water-retention agent, antifoamer, water-resistant agent, colorant and other auxiliaries commonly applied to blending with pigments for coated papers are used as necessary.

One or more coating layers may be provided on one or both sides of the base paper, to the extent that such layer(s) do riot affect the density, Young's modulus or breaking length. The recommended amount of coating used for the coating layer is 10 to 20 $g/m^2$ on each side.

The coating compositions can be applied to the base paper, using any of the publicly known coaters, such as a two-roll-size press coater, gate-roll coater, blade-type metering-size press coater, rod-type metering-size press coater, film-transfer roll coater like the Symsizer, flooded nip/blade coater, jet fountain/blade coater, coater with short-dwell-time applicator, as well as a rod-type metering coater using a grooved rod or plain rod in stead of the blade, curtain coater or die coater.

For improved paper smoothness and print quality, the techniques discussed earlier may be used to treat the surface to the extent that the use of any of such techniques does not affect the density. The surface may be treated using any of the publicly known surface-treatment devices, including the super-calender that uses resilient cotton rollers, and the soft nip-calender that uses resilient synthetic-resin rollers. The soft nip-calender can be used for high-temperature surface treatment applications, since its synthetic-resin rollers can be set to withstand a higher surface temperature than cotton rollers. The soft nip-calender is also ideal when the same level of smoothness is intended, since its line pressure may be set to a lower level than that of the super-calender, thus allowing to obtain a coated paper having lower density and greater smoothness. The recommended density of the coated printing paper in the present invention is 1.00 g/m$^3$ or less, but more preferably 0.90 g/m$^3$ or less.

EXAMPLES

The following is a detailed explanation of this invention using examples and comparative examples. However, the invention is not limited to the examples and comparative examples provided.

Unless otherwise specified, the part(s) and percent used in the examples and comparative examples refer to the part(s) by weight and weight percent, respectively. The coated printing papers obtained were tested in accordance with the methods of evaluation described below:

<Evaluation Methods>

(Basis Weight)
JIS P 8124: 1998 was followed.

(Density)
JIS P 8118: 1998 was followed.

(Young's Modulus)
The Young's modulus was obtained by measuring the flexural modulus of elasticity in accordance with the JIS P 8113: 1998.

(Breaking Length)
JIS P 8113: 1998 was followed.

(Pliability: Ease of Flipping Pages)
A book model was made by clip-binding 100 sheets of blank paper cut to A5 size, and 10 panelists rated the ease of flipping the book's pages on a four-level scale: ⊙ Very good, ○ Good, Δ Somewhat difficult and × Difficult.

(Workability with Printing Machinery)
A sample web of paper 6,000 meters long was printed using an web offset press at a print speed of 250 m/min., and variations of tension at the in-feed unit and cooling-roller unit were evaluated on a three-level scale: ○ Small, Δ Slightly large and × Large or tearing observed.

(Volumetric Particle-size Distribution Measurement for Pigment)
The volumetric particle-size distribution was measured using the laser diffraction/dispersed particle-size distribution measurement instrument (the Mastersizer S, manufactured by Malvern) to calculate the percentage of particles that were within the range of 0.4 μm to 4.2 μm.

(Coverage)
The coated paper was immersed in burnout processing solvent (2.5% ammonium chloride, 50% isopropyl alcohol) for two minutes, allowed to air-dry, then heated for 20 minutes in an air dryer controlled to 200° C. Ten panelists evaluated the color variations derived from variations in the amount of coating applied to the sample using a four-level scale: ⊙ Very good, ○ Good, Δ Slightly poor and × Poor.

(Sheet Gloss)
JIS P 8142: 1998 was followed.

(Print Gloss)
The RI-II type printing tester was used to print with 0.30 cc of sheet-fed process ink manufactured by Toyo Ink Mfg. Co., Ltd. (product name: TK HYECOO Magenta MZ), and the test sample was allowed to stand for 24 hours before measurements for the surface of the printed material obtained were taken, in accordance with the JIS P 8142: 1998.

(Gloss Variation)
Small-scale gloss variations on the surface of white paper were evaluated by 10 panelists using a four-level scale: ⊙ Very good, ○ Good, Δ Slightly poor and × Poor.

Example 1

A coated printing paper was obtained by applying the liquid coating containing 80 parts of heavy calcium carbonate, 10 parts of secondary kaolin and 10 parts of fine kaolin particles as pigments, 0.05 part of sodium polyacrylate as a dispersant, and 11 parts of carboxy-modified styrene butadiene latex and four parts of phosphate esterified starch as binders, and was adjusted to a concentration of 65% with the addition of water, to both sides of the base paper containing 100 parts of chemical pulp as paper pulp, 12 parts of precipitated calcium carbonate as a filler, and 0.3 part of ester compound comprising polyhydric alcohol and fatty acid (KB-110, manufactured by Kao Corporation) as a softening agent and having a basis weight of 64 g/m$^2$, using the blade coater at a coating speed of 800 m/min. so that 14 g/m$^2$ of the coating could be applied to each side.

Example 2

A coated printing paper was obtained in the same manner as described in Example 1, except that the liquid coating contained 80 parts of heavy calcium carbonate and 20 parts of fine kaolin particles as pigments.

Example 3

A coated printing paper was obtained by applying the liquid coating containing 65 parts of heavy calcium carbonate, seven parts of secondary kaolin and 28 parts of fine kaolin particles as pigments, 0.05 part of sodium polyacrylate as a dispersant, and nine parts of carboxy-modified styrene butadiene latex and 2.5 parts of phosphate esterified starch as binders, and was adjusted to a concentration of 64% with the addition of water, to both sides of the base paper containing 100 parts of chemical pulp as paper pulp, 12 parts of precipitated calcium carbonate as a filler, and 0.5 part of ester compound comprising polyhydric alcohol and fatty acid (KB-110, manufactured by Kao Corporation) as a softening agent and having a basis weight of 76 g/m$^2$, using the blade coater at a coating speed of 500 m/min. so that 13 g/m$^2$ of the coating could be applied to each side.

Example 4

A coated printing paper was obtained by applying the liquid coating containing 80 parts of heavy calcium carbonate, 10 parts of secondary kaolin and 10 parts of fine kaolin particles as pigments, 0.05 part of sodium polyacrylate as a dispersant, and 11 parts of carboxy-modified styrene butadiene latex and four parts of phosphate esterified starch as binders, and was adjusted to a concentration of 65% with the addition of water, to both sides of the base paper containing 100 parts of chemical pulp as paper pulp, 12 parts of precipitated calcium carbonate as a filler, and 0.3 part of ester compound comprising polyhydric alcohol and fatty acid (KB-115, manufactured by Kao Corporation) as a softening agent and having a basis weight of 64 g/m$^2$, using the blade coater at a coating speed of 800 m/min. so that 14 g/m$^2$ of the coating could be applied to each side.

Example 5

A coated printing paper was obtained by applying the liquid coating containing 80 parts of heavy calcium carbonate and 20 parts of fine kaolin particles as pigments, 0.05 part of sodium polyacrylate as a dispersant, and 11 parts of carboxy-modified styrene butadiene latex and four parts of phosphate esterified starch as binders, and was adjusted to a concentration of 65% with the addition of water, to both sides of the base paper containing 100 parts of chemical pulp as paper pulp, 12 parts of precipitated calcium carbonate as a filler, and 0.6 part of ester compound comprising polyhydric alcohol and fatty acid (KB-110, manufactured by Kao Corporation) as a softening agent and having a basis weight of 64 g/m$^2$, using the blade coater at a coating speed of 800 m/min. so that 12 g/m$^2$ of the coating could be applied to each side.

Comparative Example 1

A coated printing paper was obtained by applying the liquid coating containing 80 parts of heavy calcium carbonate, 10 parts of secondary kaolin and 10 parts of fine kaolin particles as pigments, 0.05 part of sodium polyacrylate as a dispersant, and 11 parts of carboxy-modified styrene butadiene latex and four parts of phosphate esterified starch as binders, and was adjusted to a concentration of 65% with the addition of water, to both sides of the base paper containing 100 parts of chemical pulp as paper pulp and 12 parts of precipitated calcium carbonate as a filler and having a basis weight of 76 g/m$^2$, using the blade coater at a coating speed of 800 m/min. so that 14 g/m$^2$ of the coating could be applied to each side.

Comparative Example 2

A coated printing paper was obtained by applying the liquid coating containing 65 parts of heavy calcium carbonate, seven parts of secondary kaolin and 28 parts of fine kaolin particles as pigments, 0.05 part of sodium polyacrylate as a dispersant, and nine parts of carboxy-modified styrene butadiene latex and 2.5 parts of phosphate esterified starch as binders, and was adjusted to a concentration of 64% with the addition of water, to both sides of the base paper containing 100 parts of chemical pulp as paper pulp and 12 parts of precipitated calcium carbonate as a filler and having a basis weight of 103 g/m$^2$, using the blade coater at a coating speed of 500 m/min. so that 13 g/m$^2$ of the coating could be applied to each side.

Comparative Example 3

A coated printing paper was obtained by applying the liquid coating containing 95 parts of heavy calcium carbonate and five parts of secondary kaolin as pigments, 0.05 part of sodium polyacrylate as a dispersant, and four parts of carboxy-modified styrene butadiene latex and 20 parts of phosphate esterified starch as binders, and was adjusted to a concentration of 40% with the addition of water, to both sides of the base paper containing 100 parts of chemical pulp as paper pulp and 12 parts of precipitated calcium carbonate as a filler and having a basis weight of 55 g/m$^2$, using the film-transfer roll coater at a coating speed of 1,000 m/min. so that 3 g/m$^2$ of the coating could be applied to each side, and additionally applying the liquid coating containing 80 parts of heavy calcium carbonate and 20 parts of fine kaolin particles as pigments, 0.05 part of sodium polyacrylate as a dispersant, and 11 parts of carboxy-modified styrene butadiene latex and four parts of phosphate esterified starch as binders, and was adjusted to a concentration of 64% with the addition of water, to both sides of the above paper, using the blade coater at a coating speed of 900 m/mm. so that 11 g/m$^2$ of the coating could be applied to each side.

Comparative Example 4

A coated printing paper was obtained in the same manner as described in Comparative Example 3, except that the base paper was produced at a basis weight of 82 g/m$^2$.

Comparative Example 5

A coated printing paper was obtained in the same manner as described in Example 1, except that the base paper was produced at a basis weight of 40 g/m$^2$ and that 12 g/m$^2$ of the coating was applied to each side.

The basis weight, density, Young's modulus in the machine direction and breaking length in the machine direction for each of the coated printing papers manufactured under the conditions described above were measured so that the product of the four elements could be calculated. Additional evaluations were conducted to examine the ease of flipping pages with regard to said papers when bound into a book, as well as each paper's workability with the printing machinery. The results of the above are shown in Table 1.

TABLE 1

| Density (g/cm$^3$) | Breaking length (km) | Young's modulus ($\times 10^8$ N/m$^2$) | Product of four elements ($\times 10^{21}$ g$^2$ · N/m$^6$) | Addition of softening agent | Pliability and ease of flipping | Workability with printing machinery |
|---|---|---|---|---|---|---|
| 0.85 | 5.50 | 6.52 | 2.79 | Yes | ◎ | ○ |
| 0.90 | 4.89 | 6.70 | 2.70 | Yes | ◎ | ○ |
| 0.88 | 5.76 | 6.28 | 3.27 | Yes | ○ | ○ |
| 0.85 | 5.45 | 6.50 | 2.75 | Yes | ◎ | ○ |
| 0.91 | 4.80 | 6.00 | 1.97 | Yes | ◎ | ○ |
| 1.00 | 5.42 | 7.53 | 4.24 | No | Δ | Δ |
| 0.93 | 5.91 | 6.36 | 4.51 | No | X | ○ |
| 0.99 | 6.60 | 8.72 | 4.69 | No | X | Δ |
| 0.96 | 5.93 | 7.75 | 4.84 | No | X | ○ |
| 0.96 | 3.00 | 3.22 | 0.59 | No | Δ | X |

As is evident from the data shown in Table 1, when the product of the basis weight, density, Young's modulus in the machine direction and breaking length in the machine direction is within the range of no less than $1.0\times10^{21}$ $g^2\cdot N/m^6$ but not greater than $4.0\times10^{21}$ $g^2\cdot N/m^6$, the coated printing paper offers superior pliability regardless of any difference in the composition of the base paper or pigment coating layer, thus achieving greater ease in flipping pages, higher bulk, and excellent workability with the printing machinery.

Example 6

A coated printing paper was obtained by applying the liquid coating containing pigments comprising 100 parts of kaolin produced in Brazil (Capim DG, manufactured by Rio Capim; volumetric particle-size distribution: 0.40 to 4.20 μm: 71.7%) as pigments (volumetric particle-size distribution: 0.40 to 4.20 μm: 71.7%), 0.1 part of sodium polyacrylate as a dispersant, and 11 parts of carboxy-modified styrene butadiene latex and three parts of phosphate esterified starch as binders, and was adjusted to a concentration of 65% with the addition of water, to both sides of the base paper containing 100 parts of chemical pulp as paper pulp, 12 parts of precipitated calcium carbonate as a filler, and 0.3 part of ester compound comprising polyhydric alcohol and fatty acid (KB-110, manufactured by Kao Corporation) as a softening agent and having a basis weight of 64 $g/m^2$, using the blade coater at a coating speed of 800 m/min. so that 14 $g/m^2$ of the coating could be applied to each side.

Example 7

A coated printing paper was obtained in the same manner as described in Example 6, except that the liquid coating contained 20 parts of heavy calcium carbonate (FMT-90, manufactured by Fimatec; volumetric particle-size distribution: 71.7%) and 80 parts of kaolin produced in Brazil (Capim DG, manufactured by Rio Capim; volumetric particle-size distribution: 0.40 to 4.20 μm: 71.7%) as pigments (volumetric particle-size distribution: 0.40 to 4.20 μm: 71.7%).

Example 8

A coated printing paper was obtained in the same manner as described in Example 6, except that the liquid coating contained 60 parts of heavy calcium carbonate (FMT-90, manufactured by Fimatec; volumetric particle-size distribution: 0.40 to 4.20 μm: 71.7%) and 40 parts of kaolin produced in Brazil (Capim DG, manufactured by Rio Capim; volumetric particle-size distribution: 0.40 to 4.20 μm: 71.7%) as pigments (volumetric particle-size distribution: 71.7%).

Example 9

A coated printing paper was obtained in the same manner as described in Example 6, except that the liquid coating contained 50 parts of heavy calcium carbonate (FMT-90, manufactured by Fimatec; volumetric particle-size distribution: 71.7%) and 50 parts of secondary kaolin (DB Coat, manufactured by Dry Branch Kaolin Company; volumetric particle-size distribution: 61.8%) as pigments (volumetric particle-size distribution: 66.8%).

Comparative Example 6

A coated printing paper was obtained in the same manner as described in Example 6, except that the liquid coating contained 20 parts of heavy calcium carbonate (Escalon 1500, manufactured by Sankyo Seifun; volumetric particle-size distribution: 0.40 to 4.20 μm: 25.0%) and 80 parts of kaolin produced in Brazil (Capim DG, manufactured by Rio Capim; volumetric particle-size distribution: 0.40 to 4.20 μm: 71.7%) as pigments (volumetric particle-size distribution: 0.40 to 4.20 μm: 62.4%).

Comparative Example 7

A coated printing paper was obtained in the same manner as described in Example 7, except that the base paper did not contain an ester compound comprising polyhydric alcohol and fatty acid.

Comparative Example 8

A coated printing paper was obtained by applying the liquid coating containing pigments (volumetric particle-size distribution: 0.40 to 4.20 μm: 71.7%) comprising 20 parts of heavy calcium carbonate (FMT-90, manufactured by Fimatec; volumetric particle-size distribution: 0.40 to 4.20 μm: 71.7%) and 80 parts of kaolin produced in Brazil (Capim DG, manufactured by Rio Capim; volumetric particle-size distribution: 0.40 to 4.20 μm: 71.7%), 0.1 part of sodium polyacrylate as a dispersant, and 11 parts of carboxy-modified styrene butadiene latex and three parts of phosphate esterified starch as binders, and was adjusted to a concentration of 65% with the addition of water, to both sides of the base paper containing 100 parts of chemical pulp as paper pulp and 12 parts of precipitated calcium carbonate as a filler and having a basis weight of 103 $g/m^2$, using the blade coater at a coating speed of 800 m/min. so that 14 $g/m^2$ of the coating could be applied to each side.

Comparative Example 9

A coated printing paper was obtained in the same manner as described in Example 7, except that the base paper was produced at a basis weight of 40 $g/m^2$ and that 12 $g/m^2$ of the coating was applied to each side.

The basis weight, density, Young's modulus in the machine direction and breaking length in the machine direction for each of the coated printing papers manufactured under the conditions described above were measured so that the product of the four elements could be calculated. The coatability of the base paper by the coating, white-paper gloss, print gloss and gloss variation in the image area were also examined. Additional evaluations were conducted to examine the ease of flipping pages with regard to said papers when bound into a book, as well as each paper's workability with the printing machinery. The results of the above are shown in Table 2.

TABLE 2

| | Examples | | | | Comparative Examples | | | |
|---|---|---|---|---|---|---|---|---|
| | [6] | [7] | [8] | [9] | [6] | [7] | [8] | [9] |
| FMT 90 (parts) | | 20 | 60 | 50 | | 20 | 20 | 20 |
| Escalon 1500 (parts) | | | | | 20 | | | |

TABLE 2-continued

| | Examples | | | | Comparative Examples | | | |
|---|---|---|---|---|---|---|---|---|
| | [6] | [7] | [8] | [9] | [6] | [7] | [8] | [9] |
| DB coat (parts) | | | | 50 | | | | |
| Capim DG (parts) | 100 | 80 | 40 | | 80 | 80 | 80 | 80 |
| Ratio | 71.7 | 71.7 | 71.7 | 66.8 | 62.4 | 71.7 | 71.7 | 71.7 |
| Basis weight ($g/m^2$) | 91.3 | 92.1 | 90.9 | 91.2 | 91.9 | 93.5 | 128.7 | 63.8 |
| Density ($g/cm^3$) | 0.85 | 0.85 | 0.85 | 0.85 | 0.86 | 0.95 | 0.93 | 0.96 |
| Breaking length (km) | 5.50 | 5.38 | 5.51 | 5.52 | 5.41 | 6.25 | 5.89 | 2.99 |
| Young's modulus ($10^8$ $N/m^2$) | 6.52 | 6.39 | 6.55 | 6.55 | 6.55 | 7.89 | 6.35 | 3.35 |
| Product of four elements ($10^{21}$ $g^2 \cdot N/m^6$) | 2.78 | 2.69 | 2.79 | 2.80 | 2.80 | 4.38 | 4.48 | 0.61 |
| Addition of softening agent | Yes | Yes | Yes | Yes | Yes | No | No | Yes |
| Coatability | ◎ | ◎ | ◎ | ○ | Δ | ◎ | ◎ | ◎ |
| Sheet gloss (%) | 32 | 30 | 24 | 25 | 20 | 29 | 28 | 31 |
| Print gloss (%) | 55 | 52 | 43 | 42 | 30 | 50 | 47 | 52 |
| Gloss variation | ◎ | ◎ | ◎ | ○ | X | ◎ | ◎ | ◎ |
| Pliability | ◎ | ◎ | ◎ | ◎ | ◎ | X | X | Δ |
| Workability with printing machinery | ○ | ○ | ○ | ○ | ○ | X | Δ | X |

As is evident from the data shown in Table 2, when the particle-diameter distribution of pigment particles in the coating layer is such that 65 percent or more of particles are within the range of 0.4 to 4.2 μm on a volumetric basis and the product of the basis weight, density, Young's modulus in the machine direction and breaking length in the machine direction of the coated paper is within the range of no less than $1.0\times10^{21}$ $g^2\cdot N/m^6$ but not greater than $4.0\times10^{21}$ $g^2\cdot N/m^6$, the matte coated printing paper offers greater ease of flipping pages due to its superior pliability and higher bulk, as well as superior print gloss in the image area regardless of its lower sheet gloss, minimal small-scale gloss variation in the image area, and excellent workability with the printing machinery.

INDUSTRIAL FIELD OF APPLICATION

The present invention allows for the making of a coated printing paper, specifically matte coated paper, that provides higher bulk (lower density), excellent pliability, greater resistance to the tearing that might be caused by the printing machinery, as well as superior print gloss in the image area regardless of lower sheet gloss, minimal small-scale gloss variations, and excellent workability with the printing machinery.

What is claimed is:

1. A coated printing paper comprising;

a base paper comprising pulps; and a coating layer containing pigments and adhesives formed on the base paper, wherein a product of basis weight, density, Young's modulus in a machine direction, and breaking length in a machine direction which is no less than $1.0\times10^{21}$ $g^2\cdot N/m^6$ but not greater than $4.0\times10^{21}$ $g^2\cdot N/m^6$, said coating printing paper containing in the base paper a softening agent for inhibiting inner-fiber bonding of the pulps or softening fibers of the pulps themselves.

2. The coated printing paper as described in claim 1, wherein the product of basis weight, density, Young's modulus in the machine direction, and breaking length in the machine direction is no less than $2.0\times10^{21}$ $g^2\cdot N/m^6$ but not greater than $35\times10^{21}$ $g^2\cdot N/m^6$.

3. The coated printing paper as described in claim 2, wherein the coating layer has at least 9 to 25 $g/m^2$ of the coating applied to each side.

4. The coated printing paper as described in claim 3, wherein the pigment particle-diameter distribution is such that 65 percent or more of pigment particles are within the range of 0.4 to 4.2 μm on a volumetric basis.

5. The coated printing paper as described in claim 4, wherein 20 parts by weight or more of kaolin having a particle-diameter distribution in which 65 percent or more of pigment particles are within the range of 0.4 to 4.2 μm on a volumetric basis are contained per 100 parts by weight of pigments.

6. The coated printing paper as described in claim 5, wherein said coated printing paper is a matte coated paper.

7. The coated printing paper as described in claim 4, wherein 50 parts by weight or more of kaolin having a particle-diameter distribution in which 65 percent or more of pigment particles are within the range of 0.4 to 4.2 μm on a volumetric basis are contained per 100 parts by weight of pigments.

8. The coated printing paper as described in claim 7, wherein said coated printing paper is a matte coated paper.

9. The coated printing paper as described in claim 2, wherein the pigment particle-diameter distribution is such that 65 percent or more of pigment particles are within the range of 0.4 to 4.2 μm on a volumetric basis.

10. The coated printing paper as described in claim 1, wherein the coating layer has at least 9 to 25 $g/m^2$ of the coating applied to each side.

11. The coated printing paper as described in claim 10, wherein the pigment particle-diameter distribution is such that 65 percent or more of pigment particles are within the range of 0.4 to 4.2 μm on a volumetric basis.

12. The coated printing paper as described in claim 1, wherein the pigment particle-diameter distribution is such that 65 percent or more of pigment particles are within the range of 0.4 to 4.2 μm on a volumetric basis.

13. The coated printing paper as described in claim 1, wherein 20 parts by weight or more of kaolin having a particle-diameter distribution in which 65 percent or more of pigment particles are within the range of 0.4 to 4.2 μm on a volumetric basis are contained per 100 parts by weight of pigments.

14. The coated printing paper as described in claim 1, wherein 50 parts by weight or more of kaolin having a particle-diameter distribution in which 65 percent or more of pigment particles are within the range of 0.4 to 4.2 μm on a volumetric basis are contained per 100 parts by weight of pigments.

15. The coated printing paper as described in claim 1, wherein said coated printing paper is a matte coated paper.

16. The coated printing paper according to claim 1, wherein the coated printing paper has a density of 1.00 $g/m^3$ or less.

17. The coated printing paper according to claim 1, wherein the softening agent is a hydrophobic and hydrophilic compound selected from the group consisting of oil-based nonionic surfactants, sugar alcohol-based nonionic surfactants, sugar-based nonionic surfactants, polyhydric alcohol-based nonionic surfactants, higher alcohol, ester compound of polyhydric alcohol and fatty acid, polyoxyalkyleneadditive of higher alcohol or higher fatty acid, polyoxyalkyleneadditive which is an ester compound of polyhydric alcohol and fatty acid, and fatty acid polyamidoamine.

* * * * *